US006957718B1

(12) United States Patent
Whiteside et al.

(10) Patent No.: US 6,957,718 B1
(45) Date of Patent: Oct. 25, 2005

(54) APPARATUS TO ASSIST A MECHANIC TO WORK ON A VEHICLE

(75) Inventors: Kirt E. Whiteside, Marion, OH (US); Terry L. Whiteside, Delaware, OH (US); Robert E. Studer, New Washington, OH (US); Keith R. Studer, Shelby, OH (US)

(73) Assignee: Whiteside Mfg. Co., Delaware, OH (US)

( * ) Notice: Subject to any disclaimer, the term of this patent is extended or adjusted under 35 U.S.C. 154(b) by 226 days.

(21) Appl. No.: 10/227,579

(22) Filed: Nov. 12, 2002

(51) Int. Cl.[7] ..... E06C 7/16
(52) U.S. Cl. ..... 182/115; 182/116; 182/129
(58) Field of Search ..... 182/115, 116, 15, 182/17, 131, 132, 127, 156, 129; 280/32.5, 280/32.6

(56) References Cited

U.S. PATENT DOCUMENTS

| | | | | |
|---|---|---|---|---|
| 2,701,168 | A * | 2/1955 | Schemers | 182/116 |
| 2,969,123 | A * | 1/1961 | Jamerson et al. | 182/116 |
| 2,970,668 | A * | 2/1961 | Snyder | 182/116 |
| 3,976,155 | A * | 8/1976 | Esch | 280/32.5 |
| 4,072,209 | A * | 2/1978 | Bolis | 182/116 |
| 4,397,374 | A * | 8/1983 | Rumage et al. | 182/129 |
| 4,530,419 | A * | 7/1985 | Rumage et al. | 182/106 |
| 4,542,806 | A * | 9/1985 | Olson | 182/152 |
| 4,727,958 | A * | 3/1988 | Botello | 182/15 |
| 4,863,178 | A * | 9/1989 | Friesen | 280/32.6 |
| 4,867,273 | A * | 9/1989 | Schaevitz | 182/116 |
| 5,072,955 | A * | 12/1991 | Holland et al. | 280/32.5 |
| 5,655,623 | A * | 8/1997 | Skyba | 182/116 |
| 6,105,719 | A * | 8/2000 | Lensing | 182/116 |
| 6,540,301 | B1 * | 4/2003 | Bottoms | 297/423.11 |
| 6,595,590 | B2 * | 7/2003 | Bottoms | 297/423.11 |
| 6,641,146 | B2 * | 11/2003 | Reese | 280/32.6 |

OTHER PUBLICATIONS

Three photographs of the device in existence on Apr. 11, 2001.
One photograph of a prior art device (undated).

* cited by examiner

*Primary Examiner*—Bruce A. Lev
(74) *Attorney, Agent, or Firm*—Renner, Kenner, Greive, Bobak, Taylor & Weber

(57) ABSTRACT

A device (10) which assists a person (P) in working on the engine (E) of a vehicle (V) includes a base member (11) which rests on the ground and has a socket (17) extending upwardly therefrom. A post assembly (23) includes a stem portion (24) which is selectively positionable within the socket (17). The stem portion (24) is provided with a plurality of opposed spaced apertures (27), and a pin (28) is inserted through a selected of the opposed apertures (27) and through apertures in the socket (17) to adjust the height of the device (10). A step (29) is carried by the stem portion (24) at a selected height by a pin (31) received through the selected apertures (27) and through apertures in a flange (30) carried by the step (29). A platform (36) is pivotally attached near the top of the post assembly (23) by a pin (45) and the angular orientation of the platform (36) can be adjusted and maintained by a pin (48) selectively positioned in one of a plurality of apertures (46) formed in mounting plates (44) attached to the post assembly (23).

19 Claims, 3 Drawing Sheets

APPARATUS TO ASSIST A MECHANIC TO WORK ON A VEHICLE

TECHNICAL FIELD

This invention relates to a device which is specially adapted for use by a mechanic when working on the engine of a vehicle. In particular, this invention relates to such a device which elevates and suspends the mechanic over the engine at an adjustable height and orientation.

BACKGROUND ART

Repairing or otherwise servicing the engine of a vehicle can be very hard on the body of a mechanic. Specifically, with his feet on the ground, to service an engine of a vehicle, the mechanic must lean over a fender of the vehicle to gain access to the engine from the side, or lean over the bumper of the vehicle to gain access to the engine from the front. Such can put undue stresses on the back, legs and other parts of the body of the mechanic, particularly when a lengthy repair is involved. These problems are compounded when work is to be done on the engine of a truck or other large vehicle where access to the engine is more elevated. In these instances, the mechanic may have to attempt to work from a ladder or the like which is not only awkward but also presents potential safety problems.

Some devices have been designed in an attempt to assist the mechanic when working on an engine. In one such device, a ladder-like structure is pivotally mounted to a base which has wheels and is adapted to be positioned on the ground. A horizontal platform is formed at the top of the ladder. The mechanic orients the ladder at the desired angle dependent on what portion of the engine must be accessed, and then climbs up the ladder and leans on the platform to perform the work on the engine. This device, however, is not the total solution to the problem in that the height of the device is not adjustable nor is the positioning of the steps or the inclination of the platform adjustable. As a result, dependent on the height or size of the mechanic, he may well be leaning on the platform with a portion of his body which results in discomfort, or he may find himself at an awkward working angle relative to the engine. Moreover, to guard against the device rolling on its wheels while in use, it must be provided with a braking system for the wheels which adds to the expense of the product.

Another known device has similar problems as well as presenting other safety issues. In this device, a platform pivots between the side rails of a ladder, and its height is adjustable relative to the ladder. However, there is no provision for adjustment of the step that the mechanic is standing upon when he is leaning on the platform, and, in order to save expense, the support for the platform was not designed with the strength required to hold mechanics of all sizes.

Thus, the need exists for a device which will comfortably and safely support a mechanic while working over the engine of a vehicle.

DISCLOSURE OF THE INVENTION

It is thus an object of the present invention to provide a device which can comfortably and safely position a person over the engine of a vehicle so that work can easily be performed on the engine of the vehicle.

It is another object of the present invention to provide a device, as above, which has a platform to support the user which is adjustable in height.

It is a further object of the present invention to provide a device, as above, in which the angle of inclination of the platform is adjustable.

It is an additional object of the present invention to provide a device, as above, which has steps leading up to the platform, the position of the steps relative to the platform being adjustable.

It is yet another objection of the present invention to provide a device, as above, which is portable and yet which safely carries the person while working on the engine.

These and other objects of the present invention, as well as the advantages thereof over existing prior art forms, which will become apparent from the description to follow, are accomplished by the improvements hereinafter described and claimed.

In general, an apparatus designed to assist a person who is working on the engine of a vehicle includes a base which is positionable on a surface. A socket extends upwardly from the base, and a post is positionable at selected positions in the socket. A step member is carried by the post, and a platform is pivotally carried near the end of the post.

A preferred exemplary device incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
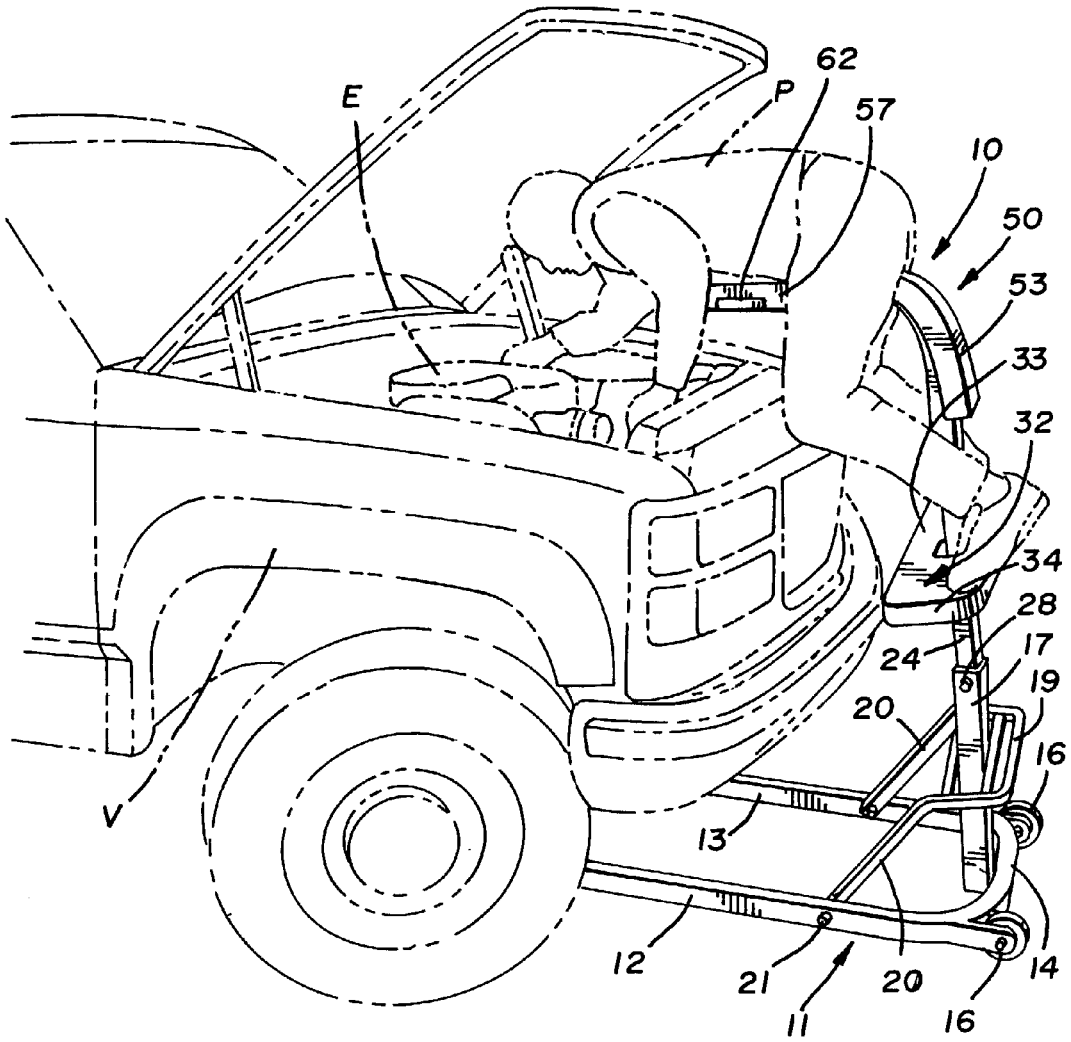
FIG. 1 is perspective view showing a device made in accordance with the present invention and showing in phantom how a person can use the device to perform work on the engine of a vehicle.

An apparatus which is designed to assist a person P when working on a vehicle V is indicated generally by the numeral 10. Device 10 is shown in FIG. 1 as being used by a person P to work on the engine E or other component underneath the hood of a vehicle V by being elevated and supported over the exposed engine E.

Figure 2:
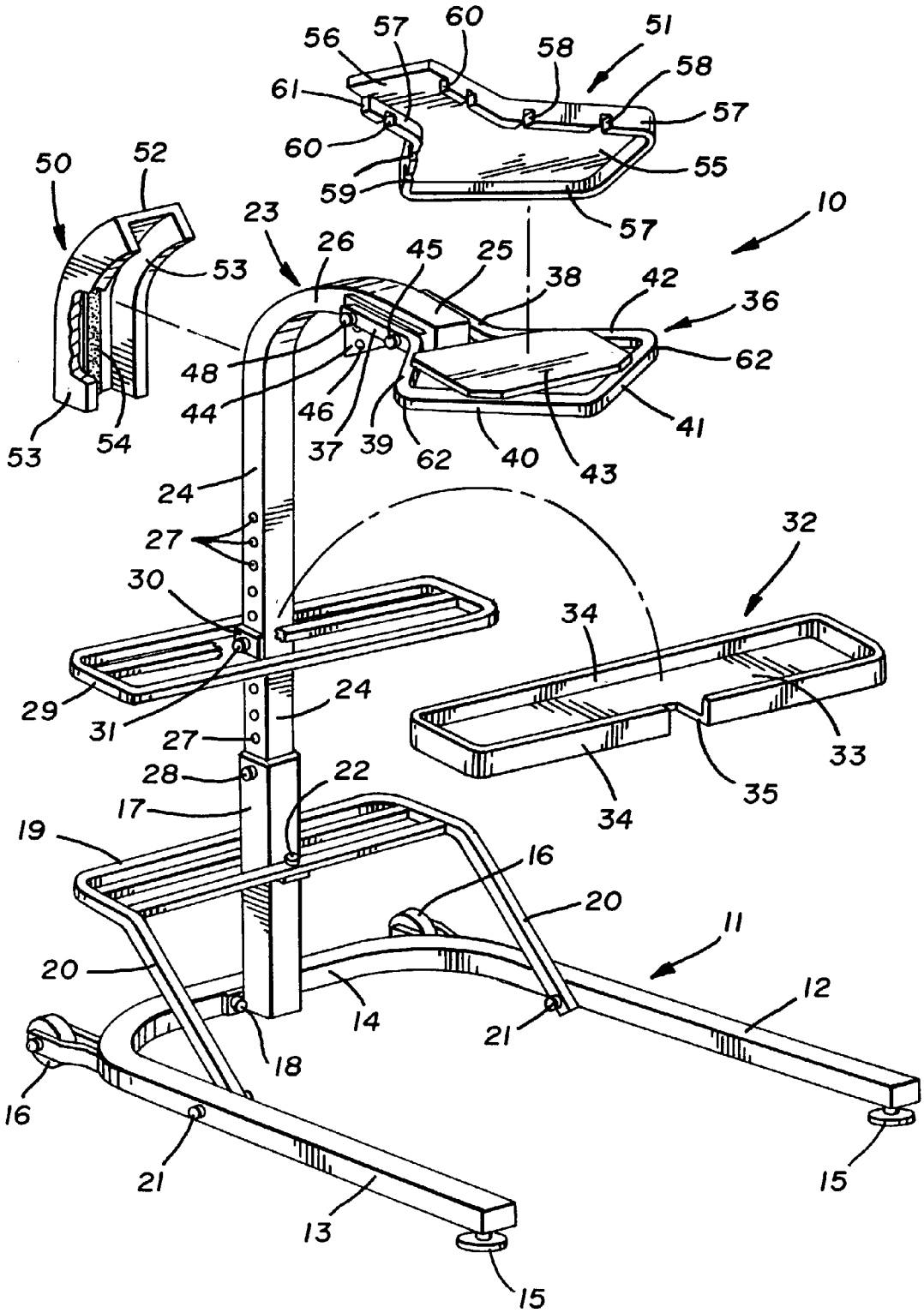
FIG. 2 is a partially broken-away, exploded, perspective view of a device made in accordance with the present invention.

As best shown in FIG. 2, device 10 includes a base member generally indicated by the numeral 11. Base member 11 is designed to rest on a work surface, such as a floor, and is generally U-shaped having opposed branches 12 and 13 interconnected at one end by a crossmember 14. The opposite end of each branch 12, 13 is provided with a foot 15 which rests on the work surface. Wheel assemblies 16 may be formed near the junction of branches 12 and 13 and crossmember 14 so that device 10 may be tilted and transported on wheel assemblies 16.

A hollow, tubular socket 17, shown as preferably being square in profile, is connected to crossmember 14 of base 11, as by bolts 18 (one shown) or the like. Therefore, socket 17 extends upwardly from base member 11. A lower step 19 has arms 20 extending angularly therefrom, the ends of which are attached by fasteners 21 to branches 12 and 13 of base 11. Step 19 is also attached to socket 17, as by fastener 22. As such, step 19 is permanently positioned laterally of socket 17 and parallel to the work surface. Step 19 with its arms 20 also serves to strengthen the mounting of socket 17 and otherwise adds stability to device 10.

A hollow tubular post assembly, shown as preferably being square, in profile, is indicated generally by the numeral 23 and includes a generally vertically oriented stem portion 24 interconnected with a generally horizontal portion 25 by an arcuate neck portion 26. Stem portion 24 is provided with a plurality of spaced apertures 27, with pairs of such apertures 27 being aligned on opposed sides of stem portion 24. Stem 24 is slidably received within socket 17 to a position selected by the user dependent on the desired height of device 10. When at such height, apertures 27 are aligned with opposed apertures in socket 17, and a pin 28 is inserted therethrough to hold post assembly 23 at the desired height. As a result, device 10 is readily adapted for use on a wide variety of sizes of vehicles such as cars where stem 24 would be inserted further into socket 17 than it would be if a larger vehicle such as a truck were being serviced.

A second step 29 is also carried at a selected height along stem 24 of post assembly 23. As such, step 29 is provided with opposed flanges 30 (one shown) having aligned apertures therein which are aligned with apertures 27 of stem 24, and a pin 31 is received therethrough. Thus, step 29 can be positioned, as desired, both relative to lower step 19 and relative to the upper horizontal portion 25 of post 23. This adjustable positioning of step 29 is advantageous not only because the stepping distance between steps 19 and 29 can be regulated, but also because the distance between the top horizontal portion 25 of post 23 and step 29 can be regulated. As will hereinafter become more evident, this is important because, as shown in FIG. 1, the user P will often stand on step 29 while performing his work and, at other times, may even kneel on step 29 to perform the work.

As a result, for comfort purposes, a pad, generally indicated by the numeral 32, may be provided for step 29. Pad 32 may be made out of any cushioning material, such as foam or the like, and, as shown, it is configured to engage step 29. Specifically, pad 32 has an upper surface 33 covering step 29 and a downwardly directed flange 34 formed along its periphery. Flange 34 thus engages the periphery of step 29 and is provided with a notch 35 which is received around stem 24 of post assembly 23. As a result, pad 32 is firmly held on step 29 yet it may be removed, if desired, by pulling upwardly on flange 34.

A platform, generally indicated by the numeral 36, is pivotally carried at the end of horizontal portion 25 of post 23. Platform 36 includes a frame having spaced opposed legs 37, 38 which support a generally square portion having sides 39, 40, 41 and 42. Thus, leg 37 continues as side 39 which turns at generally a right angle into side 40 which turns at generally a right angle into side 41 which turns at generally a right angle into side 42. The end of side 42 joins leg 38 thereby forming one continuous frame. Platform 36 also includes a reinforcing plate 43 which has its truncated corners attached, as by welding, to sides 3942 of the frame.

Figure 3:
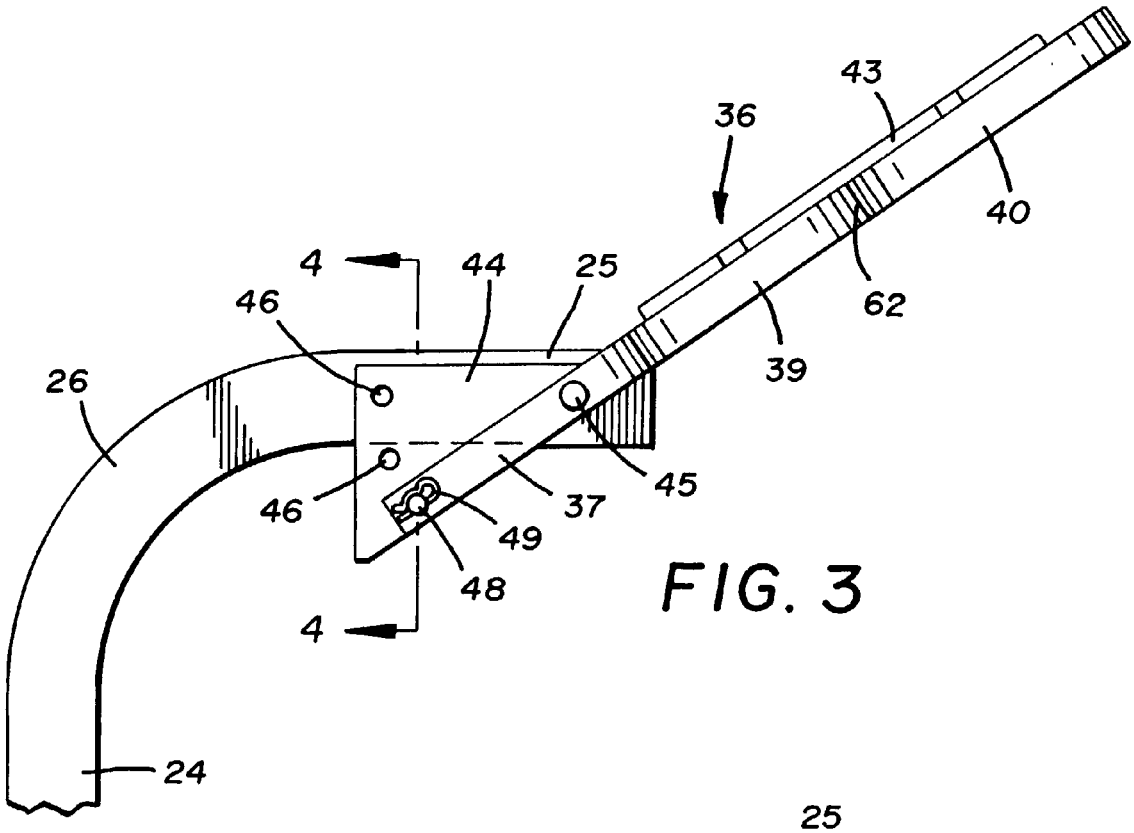
FIG. 3 is a fragmented, elevational view showing the manner in which the platform may be pivoted relative to the post of the device of the present invention.
Figure 4:
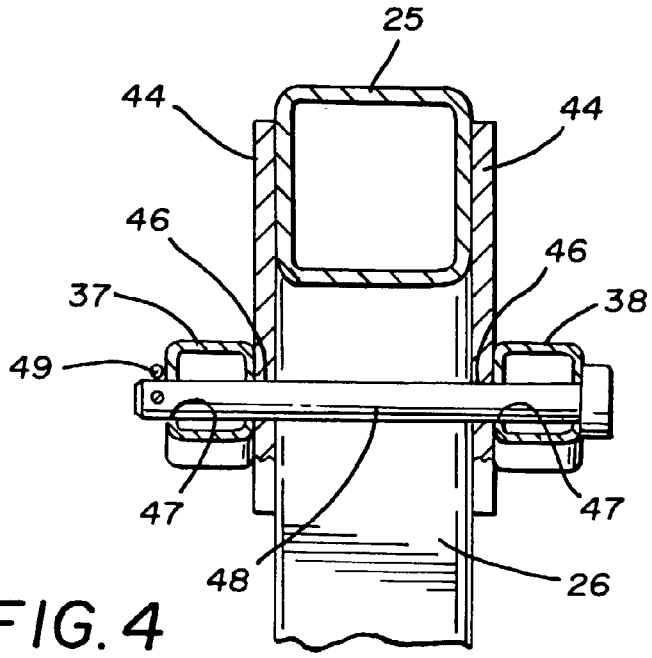
FIG. 4 is a sectional view taken substantially along line 4—4 of FIG. 3.

The manner in which platform 36 is pivotally carried by post 23 is best described with reference to FIGS. 3 and 4. A generally triangularly-shaped mounting plate 44 is carried on each side of portion 25 of post 23, and legs 37 and 38 are pivotally carried by a pin 45 which extends through legs 37 and 38, plates 44, and portion 25 of post 23. Thus, pin 45 defines an axis of rotation for platform 36; that is, platform 36 is pivotable on the axis defined by pin 45 from a generally horizontal position shown in FIG. 2 to the position shown in FIG. 3. To maintain platform 36 at the desired position, plates 44 include a plurality of circumferentially spaced apertures 46. Apertures 46 of one plate 44 are aligned with the apertures 46 of the other plate 44, and, as shown in FIG. 3, the uppermost aperture 46 is aligned with apertures formed in the walls of portion 25 of post 23. To adjust and maintain the angle of platform 36 relative to portion 25 of post 23, apertures 47 (FIG. 4) formed in legs 37, 38 are aligned with the selected aperture 46 in plates 44, and a lock pin 48 is inserted through apertures 46 and 47. Pin 48 is maintained in place by a cotter pin 49.

As a result, dependent on the angle desired, a pair of aligned apertures 46 are selected, and, with pin 48 removed, platform 36 is pivoted on pin 45 until its apertures 47 are aligned with the selected apertures 46. At this time, pin 48 can be inserted and retained in place by cotter pin 49. While it should be noted that three circumferentially spaced apertures 46 have been shown, thereby giving platform 36 three selectable positions, any number of apertures 46 and their concomitant adjustment positions could be provided without departing from the concept of the present invention.

Because, as shown in FIG. 1, the person P using device 10 will be leaning on, or otherwise engaging, platform 36 and possibly arcuate neck portion 26 of post assembly 23, it is preferable that these items be padded similar to the manner in which step 29 is padded by pad 32. To that end, a neck pad, generally indicated by the numeral 50, and a platform pad, generally indicated by the numeral 51, are provided. Pads 50 and 51, like pad 32, can be formed of any suitable cushioning material such as foam or the like.

Neck pad 50 includes an arcuate surface 52 configured to match the arc of neck portion 26 of post 23. Side flanges 53 extend from the edges of surface 52 and are adapted to snugly engage the sides of neck portion 26. To assure a positive connection between pad 50 and neck portion 26, a fastener, such as hook and loop fastener 54, may be provided on the inner surface of arcuate surface 52 and on neck portion 26. With pad 50 in place, as shown in FIG. 1, any contact by the user will be comfortable.

Platform pad 51 includes a generally rectangular top surface 55 having a neck area 56, surface 55 being the shape of, and being adapted to cover, plate 43. A flange 57 extends from generally the entire periphery of pad 51, that is, downwardly around rectangular surface 55 and along a portion of the sides of neck area 56. Flange 57 is provided with notches 58 along one edge of rectangular surface 55, and another edge of rectangular surface 55 has notches 59. The neck area 56 of flange 57 is also provided with opposed notches 60. When pad 51 is placed on platform 36, its surface 55 is generally over plate 43, and its neck area 56 is over horizontal portion 25 of post 23. Pad 51 is held in place by virtue of notches 58 engaging side 39 of the frame of platform 36 and notches 59 engaging side 42 of the frame of platform 36. In addition, notches 60 fit around and otherwise engage the ends of pin 45, and the ends 61 of flange 57 may be wedged against the ends of lock pin 48. As a result, when a person P is using device 10 as shown in FIG. 1, his chest and stomach area will be comfortably received on pad 51.

In addition, when pad 51 is positioned as just described, the corners where side 39 meets side 40 and where side 41 meets side 42 are exposed and conveniently serve as handles 62 for the user.

In view of the foregoing, it should be evident that device 10 provides several features rendering it convenient and comfortable for a person P to work on the engine E of a vehicle V. Specifically, dependent on whether the user might be standing or kneeling on step 29, the height thereof relative to step 19 and relative to platform 36 may be adjusted. The overall height of platform 36 may likewise by adjusted, and the angular orientation of platform 36 can be adjusted. As a result, the user can comfortably perform work on any area of engine E in any type of vehicle. Thus, device 10, as described herein, accomplishes the objects of the present invention and otherwise substantially improves the art.

What is claimed is:

1. An apparatus to assist a person to work on the engine of a vehicle comprising a base positionable on a surface, a socket extending upwardly from said base, a post positionable at selected positions in said socket, a step member carried by said post, a platform pivotally attached to said post near the end of said post, said platform including a frame having a pair of spaced legs, said frame having intersecting sides carried by said legs, and a pad carried by said platform, said pad being positioned so that at least some of the intersections of said sides are exposed thereby forming handles.

2. The apparatus of claim 1 wherein said step member is positionable at selected positions on said post.

3. The apparatus of claim 1 wherein said post is provided with a plurality of spaced apertures, a selected of said apertures being aligned with an aperture in said socket, and further comprising a pin received through said aligned apertures to hold said post at a selected position relative to said socket.

4. The apparatus of claim 3 wherein said step member is provided with opposed apertures to be aligned with a selected of said apertures of said post, and further comprising a pin received through said aligned apertures to hold said step member at selected positions relative to said post.

5. The apparatus of claim 1 further comprising a pivot pin near the end of said post and carrying said platform so that said platform can be positioned at a selected angular orientation relative to said post.

6. The apparatus of claim 5 further comprising means for maintaining said selected angular orientation between said platform and said post.

7. The apparatus of claim 1 further comprising a pad carried by said step member.

8. The apparatus of claim 7 wherein said pad of said step member includes an upper surface covering said step member, a flange extending downwardly from said upper surface to engage the sides of said step member, and a notch in said flange received around said post.

9. The apparatus of claim 1 wherein said base in generally U-shaped having opposed branches interconnected at one end, the other end of each of said branches being provided with a foot member.

10. The apparatus of claim 9 further comprising a wheel assembly for each said branch positioned near said one end of said branches to render the apparatus mobile.

11. The apparatus of claim 1 wherein said post includes a stem portion telescopically received in said socket, a generally horizontal portion carrying said platform, and an arcuate neck portion between said stem portion and said horizontal portion.

12. The apparatus of claim 11 further comprising a pad carried by said neck portion.

13. The apparatus of claim 12 wherein said pad of said neck portion includes an arcuate surface having side flanges extending therefrom, and means for fastening said pad of said neck portion to said neck portion.

14. The apparatus of claim 1 wherein said platform includes a plate carried by said frame.

15. The apparatus of claim 14 further comprising a pad carried by said platform.

16. The apparatus of claim 15, said pad including a surface covering said plate and a surface covering said spaced legs.

17. The apparatus of claim 16, said pad including a flange extending from the periphery of said surfaces.

18. The apparatus of claim 17, said pad including notches formed in said flange, selected of said notches engaging selected of said sides.

19. The apparatus of claim 17 further comprising a pin connecting said legs to said post, said pad including notches in said flange, said notches engaging said pin.

* * * * *